United States Patent [19]

Seki et al.

[11] Patent Number: 5,031,815

[45] Date of Patent: Jul. 16, 1991

[54] BUTTON FEEDER FOR BUTTON APPLICATOR

[75] Inventors: Fumio Seki; Yasuhiro Kobayashi, both of Toyama, Japan

[73] Assignee: Yoshida Kogyo K. K., Tokyo, Japan

[21] Appl. No.: 498,164

[22] Filed: Feb. 27, 1990

[30] Foreign Application Priority Data

Mar. 11, 1989 [JP] Japan ..... 1-27803[U]

[51] Int. Cl.[5] ..... A41H 37/10

[52] U.S. Cl. ..... 227/119

[58] Field of Search ..... 227/114, 115, 116, 117, 227/118, 119, 156

[56] References Cited

U.S. PATENT DOCUMENTS

| | | | |
|---|---|---|---|
| 3,987,950 | 10/1976 | Schmidt et al. | 227/119 |
| 4,569,470 | 2/1986 | Tanaka | 227/119 |
| 4,605,150 | 8/1986 | Ikehara | 227/119 X |
| 4,717,061 | 1/1988 | Seki | 227/119 |
| 4,799,611 | 1/1989 | Taga | 227/119 X |

*Primary Examiner*—Paul A. Bell

*Attorney, Agent, or Firm*—Hill, Van Santen, Steadman & Simpson

[57] ABSTRACT

A feed path for transporting a button body with the front face of a buttonhead facing upward is disposed between a trough, which is formed longitudinally on the underside of an upper member and has a receiving surface on its one side receiving a part of the periphery of the buttonhead, and a pressuring surface of a lower member, which faces the receiving surface and is urged resiliently upward. According to a preferable embodiment, the pressuring surface is inclined relatively downward and away from the periphery of the rear face of the buttonhead and has a recess on its side to allow a tongue to rotate. While the button body is pushed by the pusher along the feed path, a part of the periphery of the buttonhead is pressed by the pressuring surface. Accordingly, friction force is increased there to facilitate that the button body can be transported while it rotates about its axis. In this case, the tongue is also transported while it rotates in the recess freely without interference of an edge of the pressuring surface.

3 Claims, 5 Drawing Sheets

BUTTON FEEDER FOR BUTTON APPLICATOR

BACKGROUND OF THE INVENTION

1. Field of the Invention

This invention relates to a button feeder for a button applicator guiding a button body which is composed of a button with a tack member, after being delivered from a chute to a pocket below a punch of a button caulking unit, and more particularly to a button feeder guiding and indexing the direction of surface pattern provided on the front face of the button body.

2. Description of the Prior Art

In U.S. Pat. No. 4,717,061, a button feeder of this kind is disclosed and claimed. It comprises a guide base, a pushing member which is urged resiliently in a vertical and downward direction toward the guide base and has a L-shaped cross section, a wedge member which is disposed between a pressuring surface of the pressing member and the guide base and has a inclined surface and a side member which is faced by and is urged resiliently toward the pressuring member and the wedge member and has a L-shaped cross section. Then these members define a feed path. When a button body is fed along the feed path, a larger head of the button body is pinched between the wedge member and the pressuring member. Therefore, the buttonhead undergoes greater frictional resistance at one side than at the other side in the feed path. Accordingly, a pusher pushes the button body to cause it to rotate about its axis and index its direction.

However, when one side of the buttonhead is pushed by the pushing member, the button body is pushed horizontally by the inclined face of the wedge member as well as it is urged resiliently by the side member. Accordingly, the other side of the button body is contacted with a vertical wall of the side member with friction. Therefore, the button body can not be rotated smoothly due to reduced rotating force and thus can not be indexed in desired direction surely.

Further, when a tack member is pressed into the button body through a garment fabric piece, as a cap which is composed of the head of the button body is faced downward, surface pattern provided on the cap of the button body can not be seen. As a result, it is impossible to confirm the direction of the button body. Further, as the most of the entire surface of the cap is contacted with a topside of the guide base, the surface pattern of the cap is damaged when the button body is rotated while it is fed along the feed path.

SUMMARY OF THE INVENTION

It is therefore an object of the present invention to provide a button feeder to permit a button body to be indexed in its desired direction surely due to its smooth rotation while it is transported without damage on surface pattern of a cap.

In accordance with the present invention, there is provided a button feeder for button applicator comprising an upper member having a longitudinal trough on its underside, a lower member having a pressuring surface on its topside, the trough on the upper member together with the lower member forming a feed path for feeding a button body comprising a head with a tongue protruding from its rear face facing the pressuring surface while the front face of the head faces upward, and a pusher movable along the feed path causing the button body to rotate about its axis, indexing the direction of surface pattern provided on the front face of the button body with the tongue while transporting the button body to a button applicator, characterized by the provision on at least one side of the trough accommodating a part of the head of the button body, of a receiving surface contacting a part of the buttonhead, the pressuring surface being urged upward against the receiving surface, and by the provision on the lower member facing the feed path, of a means for forcing the tongue to rotate.

While the button body is pushed by the pusher along the feed path, a part of the periphery of the buttonhead is pressed by the pressuring surface. Accordingly, friction force is increased there to facilitate that the button body can be transported while it rotates about its axis. In this case, the tongue is also transported while it rotates in the recess freely without interference of an edge of the pressuring surface.

Further objects and advantages of the present invention will be apparent from the following description, reference being had to the accompanying drawing wherein preferred embodiments of the present invention are clearly shown.

DESCRIPTION OF THE PREFERRED EMBODIMENT

Figure 1:
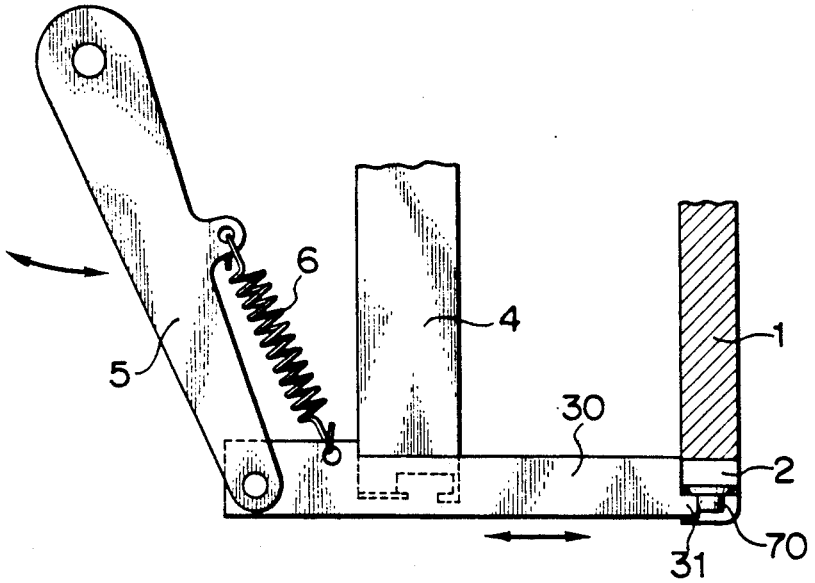
FIG. 1 is a schematic illustration showing the composition of a pusher.

In FIG. 1, a button caulking unit has an caulking punch 1 which moves vertically and is equipped with a pocket 2 gripping a button body 7 at its bottom.

A tack member (not shown) is set beneath the pocket 2 to be caulked to the button body 70. The tack member is caulked to the button body 70 integrally through a garmet fabric piece by means of the punch 1. The button body 70 is fed from the outlet of a chute 4 to the pocket 2 by a pusher 30 which moves back and forth by means of a swing movement produced by a swing lever 5. A fore end of the pusher 30 adjacent to the punch 1 is urged resiliently upward by a supension coil spring 6 connected between the pusher 30 and the swing lever 5. Then, a flange portion 72 is placed on a projection portion 31 provided on the fore end of the pusher 30, thus the projecting portion 31 supports to urge the button body 70 resiliently upward. The pusher 30 moves from the chute 4 to the pocket 2 below th punch 1, the length of its travel is set slightly longer than the periphery of a head 74 of the button body 70.

Figure 2:
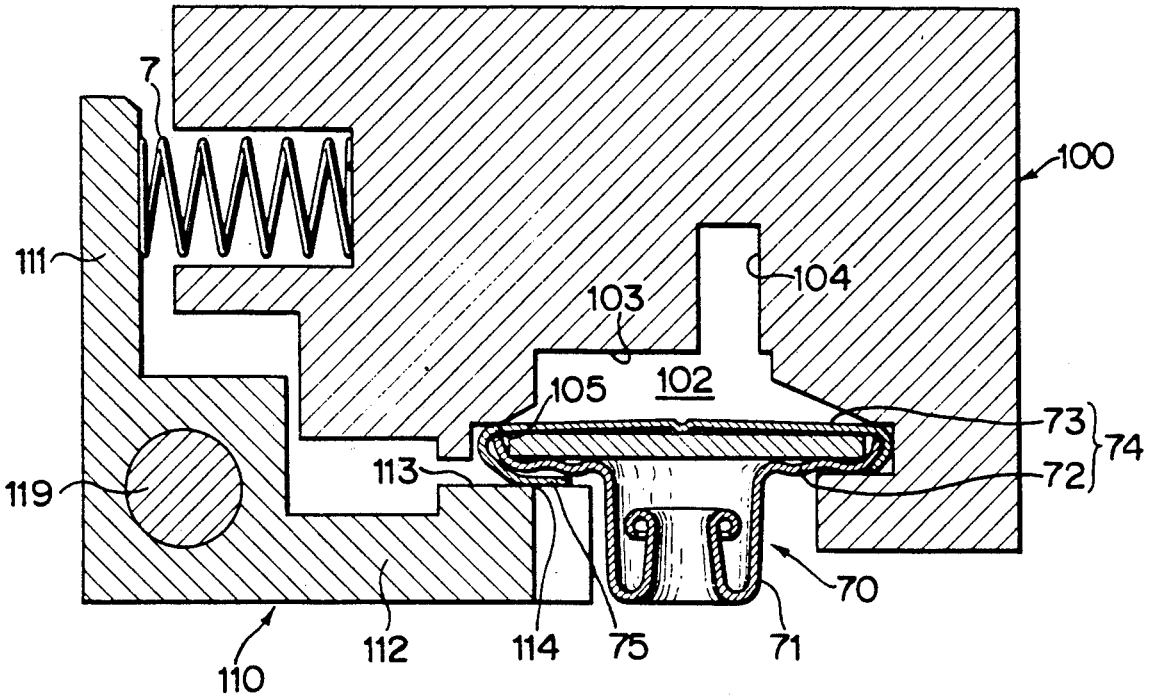
FIG. 2 is an cross sectional view of a button feeder showing an embodiment of the present invention.

As shown in FIG. 2, a feeding member for the button body 70 comprises an upper member 100 and a lower member 110 which is urged resiliently and vertically upward and has a L-shaped cross section. A feed path 102 guiding the button body 70 is defined by the upper member 100 and the lower member 110.

The upper member 100 has a trough 103 on its underside which forms the feed path 102 feeding the button body 70. The trough 103 has an pusher guide trough 104 on its topside which is connectd to the trough 103. A receiving surface 105, which receives the pressure through the button body 70 produced by the lower member 110, is formed at one side of the trough 103.

The lower member 110 has a L-shaped cross section, composed of a vertical portion 111 and a horizontal portion 112. The horizontal portion 112 is urged resiliently upward about an axis of a pin 119 by means of a compression coil spring 7 connectd between the vertical portion 111 and the upper member 100. A part of a periphery of the head 74 of the button body 70 is pinched between a pressuring surface 113 on the top of the horizontal portion 112 and the receiving surface 105 of the buttom of the upper member 100. As explained before, the feed path 102 feeding the button body 70 is defined by the trough 103 of the upper member 100 and the horizontal portion 112 of the lower member 110. The feed path 102 is used for guiding the pusher 30 while it defines a pusher guide trough 104.

As shown in FIG. 2, the button body 70 if formed as follows; a cap 73 is a caulked to a periphery of the flange portion 72 which is larger than and fixed to integrally a hollow stud 71. A head 74 of the button body 70 is composed of the flange portion 72 and the capy 73. A part of the cap 73 protrudes to form a tongue 75 under the flange portion 72. The tongue 75 is used for indexing the direction of surface pattern provided on the front face of the buttoncap 73. The button body 70 is guided in the feed path 102 while the stud 71 projects downward from the rear face of the head 74 located above and the button body 70 is contacted with only the receiving surface 105 of the upper member 100. Accordingly, most of the front face of the cap 73 is brought out of contact with the upper member 100, thus the surface pattern provided on the front face of the cap 73 is not damaged.

Figure 4:
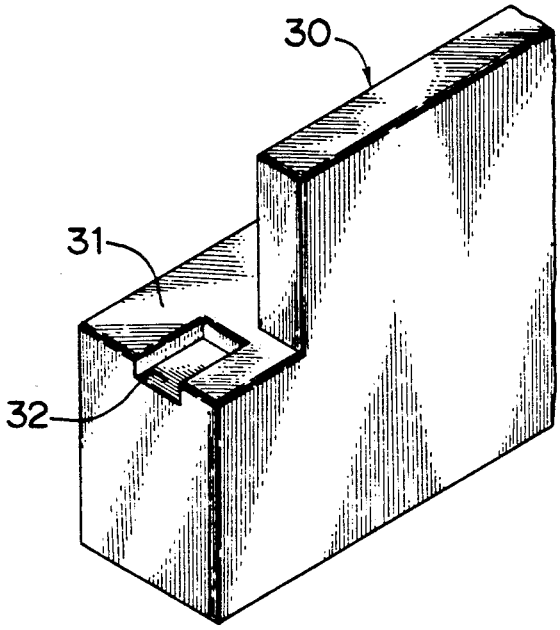
FIG. 4 is a partially perspective view of a pusher.

According to the above described composition, as a part of the periphery of the head 74 of the button body 70 is pinched between the pressuring surface 113 and the receiving surface 105, the head 74 undergoes greater frictional resistance at the pinched part than at its other part. The movement of the pusher 30 causes the button body 70 to rotate about the axis of the stud 71 and to be fed to the pocket 2. In this case, when the button body 70 is indexed in a desired direction, the tongue 75 protruding from the rear face of the cap 73 under the flange section 72 is engaged in an engaging element 32, which is defined on the topside of the projecting portion 31 as shown in FIG. 4, to arrest the rotation of the button body 70. Then, the button body 70 is guided to the pocket 2 without rotation while the tongue 75 is kept being engaged in the engaging element 32. In FIG. 4, although an engaging recess which engages the tongue 75 is shown as a preferable embodiment of the engaging element, other engaging elements also can be used. The button body 70 is caused to rotate because only a part of the buttonhead 74 is pinched vertically by receiving surface 105 defined on one side of the trough 103 of the upper member 100 and pressuring surface 113 of the lower member 110 while frictional resistance is not produced at the other part which is opposite to the pinched part of the buttonhead 74. Therefore, the button body 70 can be rotated very smoothly.

Figure 3:
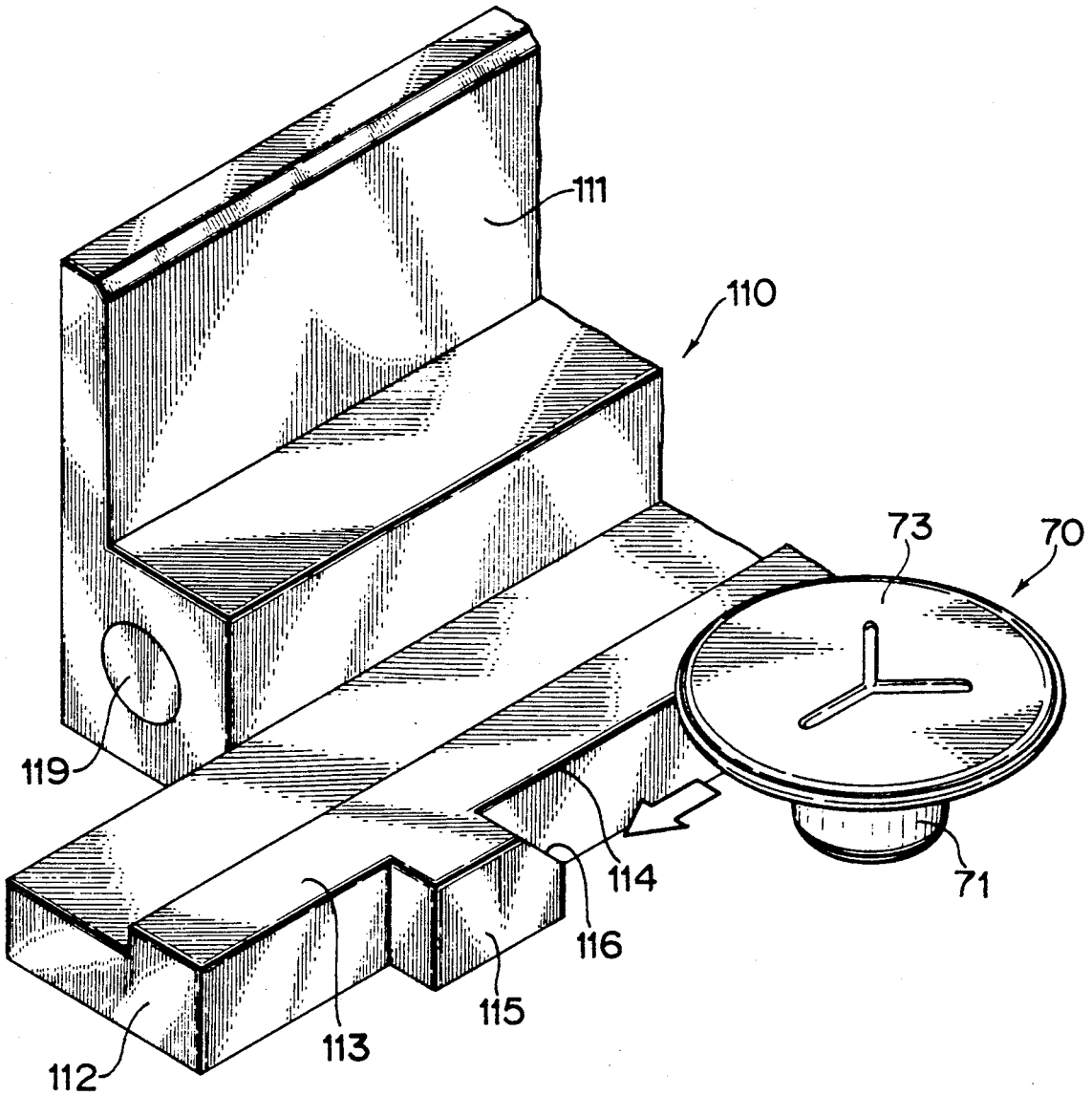
FIG. 3 is a prespective view of a lower member.

Referring to FIG. 3, when the button body 70 is rotated and transported in the direction of an arrow, the movement of the button body 70 is prevented by an edge 114 of the horizontal portion 112 of the lower member 110; the button body 70 is fed without its rotation or is disengaged from the pressuring surface 113 while the button body 70 is hooked to the edge 114. In order to prevent such situation, a projection 115 which is a means for forcing the tongue 75 to rotate and on whose topside a tapered surface 116 inclined rearward is provided, if formed on the side of the horizontal portion 112. Therefore, the tongue 75 is led to mount on the pressuring surface 113 through the tapered surface 116 smoothly while the tongue 75 rotates without being hooked to the edge 114.

The button feeder of the present invention has the composition explained before. The button body 70 delieved through the chute 4 is fed along the feed path 102 to the pocket 2 of the caulking unit by the pusher 30 while the head 74 of the button body 70 is mounted on the projecting portion 31 of the pusher 30. In this case, a part of the head 74 of the button body 70 which is urged resiliently by the pusher 30 and the lower member 110 is pinched between the pressuring surface 113 of the lower member 110 and the receiving surface 105 of the upper member 100. Then, the pressure applied to the pinched part of the button body 70 increases the frictional resistance there. Therefore, the button body 70 rotates smoothly and is transported according to the forward movenent of the pusher 30, while the tongue 75 is engaged by the engaging element 32 of the pusher 30, to the pocket 2 with a desired direction of the button body 70.

Figure 5:
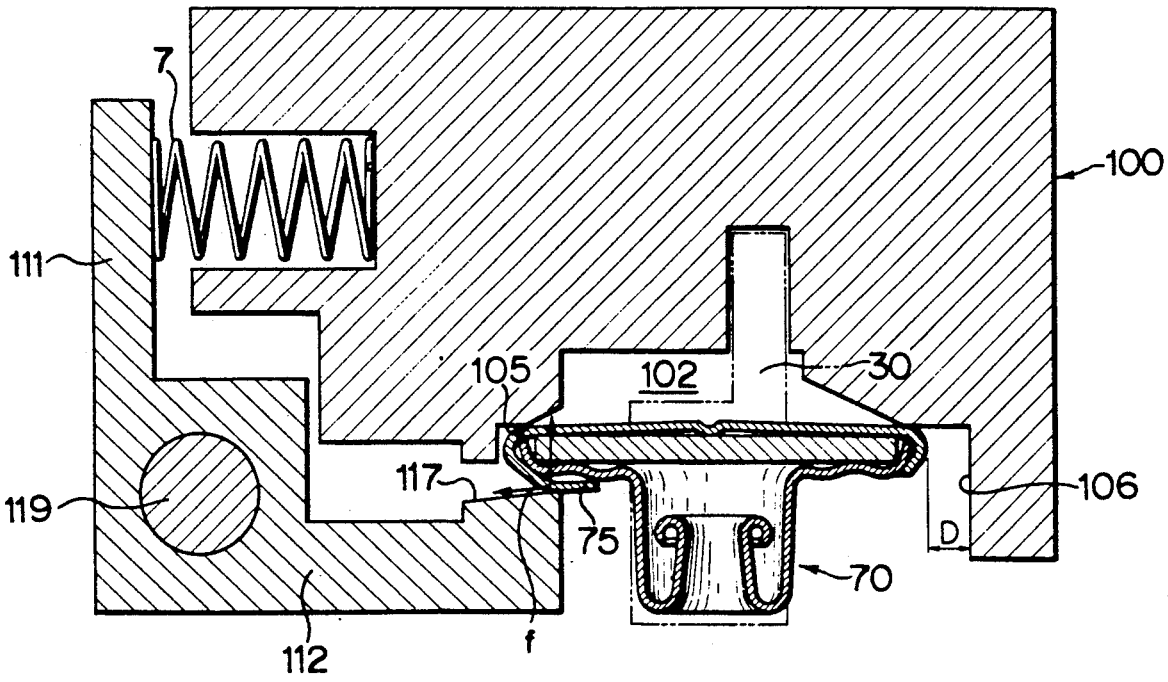
FIG. 5 is a cross sectional view of a button feeder relating to another embodiment.
Figure 6:
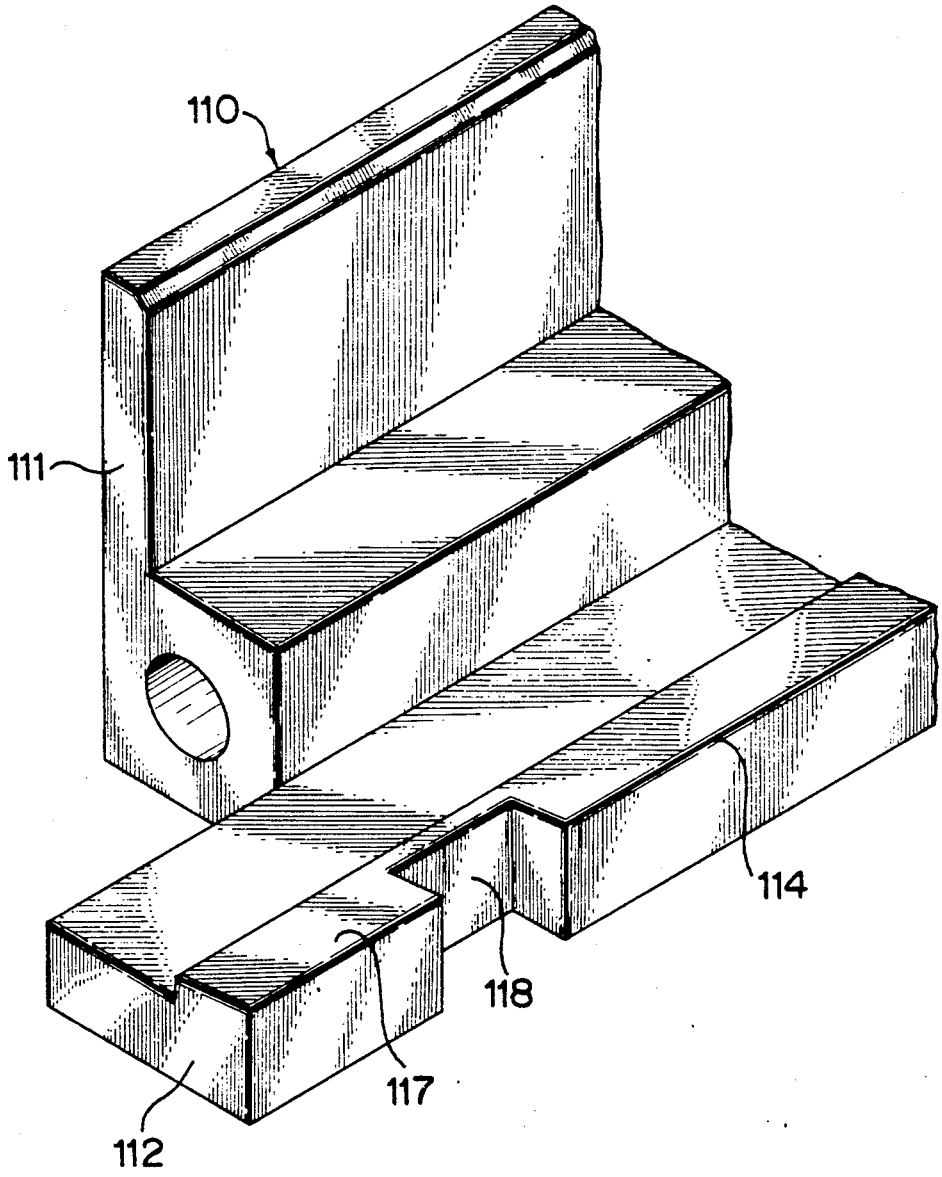
FIG. 6 is a perspective view of a lower member relating to another embodiment.

Another embodiment where the tongue 75 can rotate smoothly and surely as well as the button body 70 is led to be mounted on the pressuring surface 113 is shown in FIGS. 5 and 6. According to this embodiment, instead of the pressuring surface 113, an inclined pressuring surface 117 sloping relatively downward and away from the periphery of the rear face of the buttonhead 74 is used. As shown in FIG. 5, the button body 70 undergoes a vertical component force f in the left direction of the plane of this figure due to this inclined pressuring surface 117. In the opposite side of the head 74, the button body 70 is not pushed to a guide wall 106 which is an inner vertical wall of the upper member 100. Therefore, the periphery of the cap 73 is brought out of contact with the guide wall 106, thus the button body 70 can rotate more smoothly. Further, as shown in this figure, a suitable distance D between a guide wall 106 and the cap 73 provides a button feeder which can be used widely for various sizes of buttons.

In this embodiment, the pressuring surface of the lower member 110 is formed to be the inclined pressuring surface 117. However, in that embodiment explained before, the pressuring surface 113 can be inclined in relation to the rear face of the button body 70 by adjusting force of the compression coil spring 7 or setting a convenient position of the pin 119. Therefore, this pressuring surface 113 of that embodiment is also inclined like the inclined pressuring surface 117 of this embodiment.

As shown in FIG. 6, instead of the projection 115 with the tapered surface 116, a recess 118 is provided on the side of the lower member 110. In case of the projection 115 in that embodiment explained before, as the tongue 75 of the button body 70 has a circular arc-shaped cross section, after the button body 70 is mounted on the projection 115, the surface of the tongue 75 is in a point contact with the topside of the projection 115. Therefore, the frictional resistance is decreased there, thus the button body 70 can not rotate.

Figure 7:
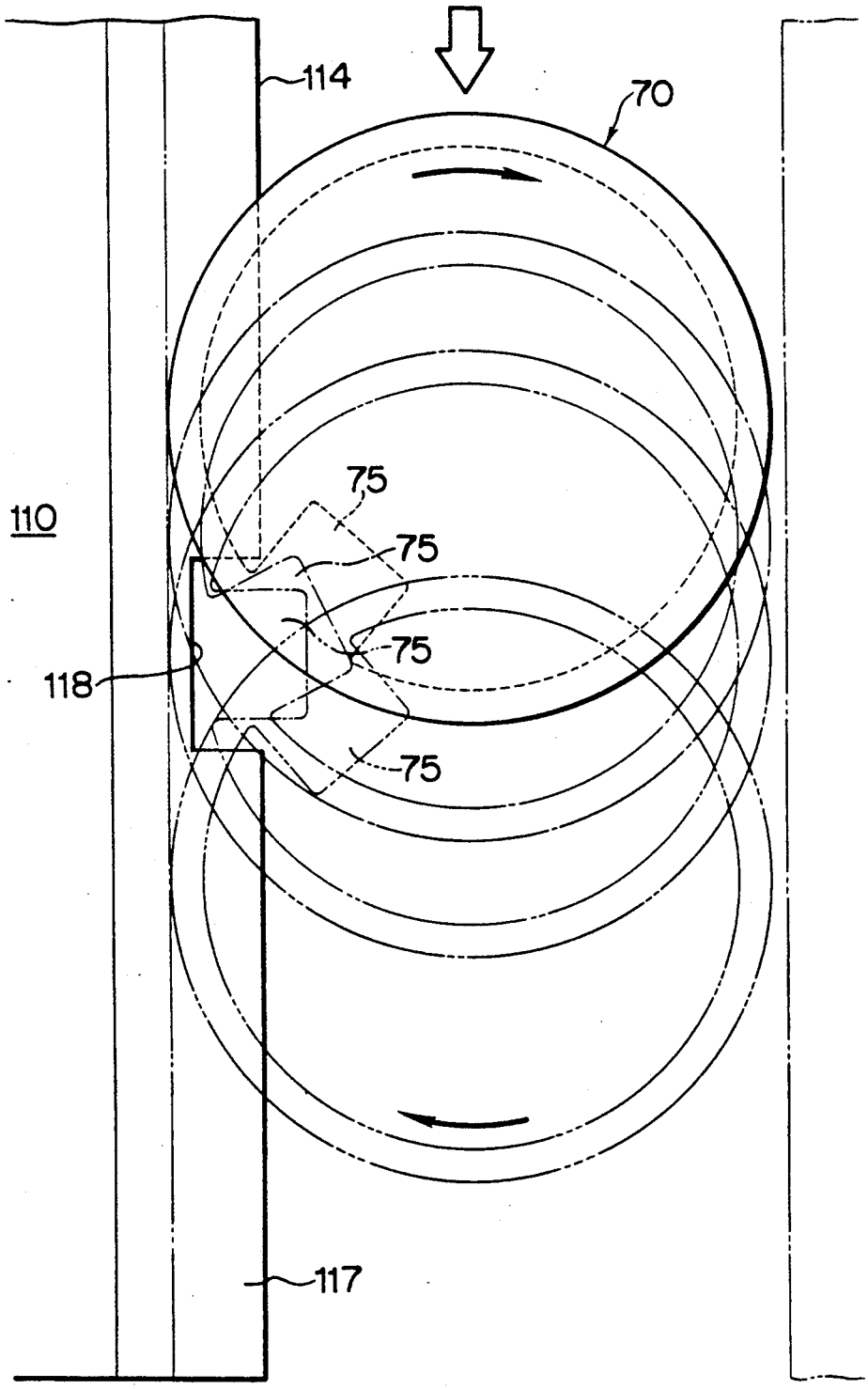
FIG. 7 is a schematic illustration of a movement of the button body by the lower member shown in FIG. 6.

In order to prevent such situation, the recess 118 is provided as explained before. Accordingly, as shown in FIG. 7, the button body 70 is allowed to rotate smoothly in the recess 118 while the tongue 75 is disengaged from the inclined pressuring surface 117.

It is clear from the above mentioned explanation that the means composed of the projection 115, the inclined pressuring surface 117 and the recess 118 forces the tongue 75 to rotate.

What is claimed is:

1. A button feeder adapted for feeding round headed button bodies having tongues at the rear face of the bodies thereof to a button application and including a pusher for pushing the button bodies comprising:

an upper member provided with a longitudinal trough on its underside with a receiving surface on one side of the trough contacting the periphery of the front face of the head of the button body, the trough serving to guide the button body with the front face of its head facing upward, as well as the pusher, a lower member provided with a pressuring surface facing the receiving surface of the upper member, the pressuring surface being urged against and guiding the periphery of the rear face of the button-head provided with the tongue, with a means for forcing the tongue to rotate provided in a part of the pressing surface, and the pusher inserted in a feed path for the button body formed between the trough in the upper member and the pressuring surface of the lower member to transport the button body by pushing it sideways, and provided with an engaging element at its end which engages the tongue;

wherein the means for forcing the tongue to rotate comprises a projection with a tapered surface on its top inclined rearward in relation to the direction in which the button body is fed.

2. A button feeder of claim 1, wherein the means for forcing the tongue to rotate comprises an inclined pressuring surface sloping relatively downward and away from the periphery of the rear face of the button head.

3. A button feeder of claim 2, wherein the means for forcing the tongue to rotate comprises a recess formed in the pressuring surface, sufficiently large to capture the tongue and allow it to rotate about the axis of the button body.

* * * * *